US006233805B1

(12) United States Patent
Burgholzer

(10) Patent No.: US 6,233,805 B1
(45) Date of Patent: May 22, 2001

(54) ARRANGEMENT FOR MANIPULATING AN PIN IN AN ELECTRICAL ASSEMBLY INCLUDING A RECIPROCATING ENGAGING MEMBER

(75) Inventor: Bruce L. Burgholzer, Montgomery, IL (US)

(73) Assignee: Lucent TechnologiesInc., Murray Hill, NJ (US)

( * ) Notice: Subject to any disclaimer, the term of this patent is extended or adjusted under 35 U.S.C. 154(b) by 0 days.

(21) Appl. No.: 09/396,856

(22) Filed: Sep. 15, 1999

(51) Int. Cl.[7] ..... B25B 27/14
(52) U.S. Cl. ..... 29/278; 29/280
(58) Field of Search ..... 29/278, 280, 739, 29/741

(56) References Cited

U.S. PATENT DOCUMENTS

| | | | | |
|---|---|---|---|---|
| 3,008,228 | * | 11/1961 | Crotty | 29/280 |
| 3,074,155 | * | 1/1963 | Cootes et al. | 29/278 |
| 3,765,075 | | 10/1973 | Olney, Jr. et al. . | |
| 4,062,078 | | 12/1977 | Brutschy . | |
| 4,069,586 | | 1/1978 | Skelton . | |
| 4,173,076 | | 11/1979 | Gossage . | |
| 4,371,013 | | 2/1983 | Camp . | |
| 4,501,054 | * | 2/1985 | Morgan | 29/278 |
| 5,797,177 | | 8/1998 | Simmons et al. . | |
| 5,815,917 | | 10/1998 | Clark et al. . | |

OTHER PUBLICATIONS

*General No. 87 Instructions* (General Tools Mfg. Co., Inc. 1991).
*Berg Metral Shelf Level BackPlane Repair Kit* (May 22, 1992).

* cited by examiner

*Primary Examiner*—Lee Young
*Assistant Examiner*—Rick Kiltae Chang
(74) *Attorney, Agent, or Firm*—Maginot, Addison & Moore

(57) ABSTRACT

An arrangement for repairing a backplane assembly having a backplane pin is disclosed. The arrangement includes an actuation assembly having a housing and a biasing mechanism. The arrangement also includes a pin engaging member having a tip for engaging the backplane pin. The pin engaging member is (i) secured to the housing and (ii) mechanically coupled to the biasing mechanism so that the pin engaging member is reciprocally movable relative to the housing between (1) a retracted position in which the tip of the pin engaging member is urged toward the housing and (2) an extended position in which the tip of the pin engaging member is urged away from the housing. An associated method of repairing an electrical assembly is also disclosed.

12 Claims, 12 Drawing Sheets

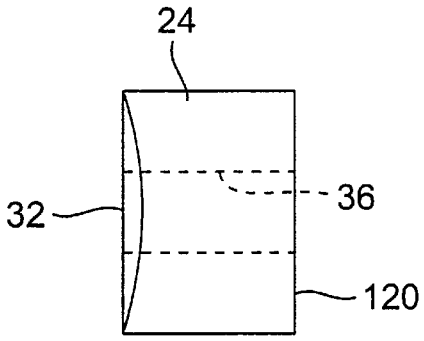
FIG. 11
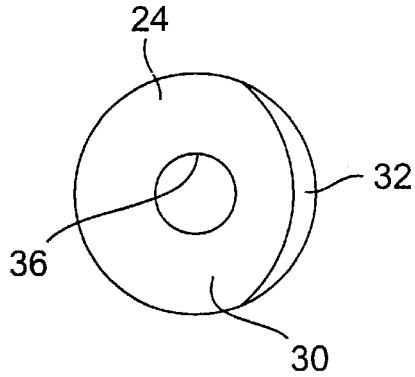
FIG. 12
FIG. 13
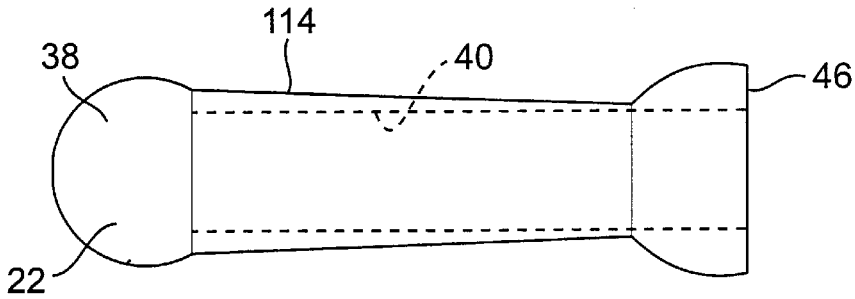
FIG. 14
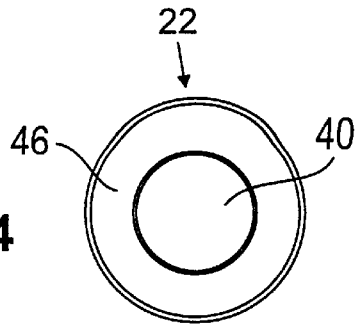

ARRANGEMENT FOR MANIPULATING AN PIN IN AN ELECTRICAL ASSEMBLY INCLUDING A RECIPROCATING ENGAGING MEMBER

FIELD OF THE INVENTION

This invention generally relates to an arrangement and method for repairing an electrical assembly. This invention particularly relates to an arrangement and method for repairing a backplane assembly having a plurality of pins.

BACKGROUND OF THE INVENTION

In the manufacture of some types of electrical assemblies, such as rigid pin-populated printed wiring boards, or backplanes, as many as 10,000 terminal pins are inserted into apertures of each of the backplanes. Backplanes typically have an elongated configuration. For example, one common type of backplane measures eight inches by twenty-two inches. Typically, the spacing between adjacent apertures on each backplane is relatively narrow. For example, the spacing between apertures on backplanes is often as little as 2 mm. Moreover, each terminal pin typically has a cross section of, for example, 0.50 $mm^2$, except in those cases in which the pin is formed with (1) lateral ears having a push shoulder and (2) an aperture-engaging portion intermediate the ends thereof. In either event, the pin is relatively slender and typically measures from 11 mm to 26 mm in length.

Each of the pins has a slender shank portion which extends from opposite sides of the backplane. After the terminal pins have been assembled into the backplane, the backplane is mounted in a frame where external wiring can be secured to the pins on one side of the backplane commonly referred to as the wiring side. Other printed wiring boards, referred to as circuit packs, have electronic components electrically and mechanically secured thereto and have receptacles secured to one end thereof. The receptacles of these boards ultimately are inserted over selected ones of the pins extending from the other side of the backplane commonly referred to as the component side.

During the insertion of the circuit packs into the backplane and during subsequent handling of the pin-populated backplane, some of the pins may be undesirably broken or bent. Broken or bent pins can lead to assembly complications and thus reduce the value of the backplane.

In particular, since the component side of the pins are destined for insertion into a receptacle, it is important that no broken pins are present in the pin-populated backplane and that the pins are axially straight with respect to the plane of the backplane within an acceptable tolerance. Otherwise, a slightly bent pin on the component side, for example. could be misaligned with its mating aperture in the receptacle. As the receptacle is moved into place, the bent pin would engage the face of the receptacle and would be bent further towards the surface of the backplane thereby failing to provide the required electrical connection. In addition, any broken pin present in the pin-populated backplane would also result in a failure to make the required electrical connection. Therefore, it is desirable to replace any bent or broken pins with new pins.

Replacing broken or bent pins in a backplane is difficult due to a number of reasons. For example, the spacing and size of the pins makes them difficult to manipulate with ordinary tools. In particular, as discussed above the pins are positioned within the backplane on a grid spacing format such that each pin is closely spaced apart from its neighboring pins, often by no more than 2 mm. Consequently, as a result of the pins being so closely arranged, it is very difficult to remove and replace any broken or bent pins from the backplane without disturbing the adjacent pins. In addition, after the backplanes are mounted in an assembly or shelf, the space behind the backplanes is often relatively small. This small space impedes the access to the backplanes, and thus adds to the difficulty in utilizing the appropriate tools to replace broken or bent pins.

Heretofore, the tools utilized to replace broken or bent pins in a backplane have been relatively large and bulky, and thus difficult to manipulate in the above described space limitations. For example, one commercially available tool for inserting a replacement pin into a backplane includes a long cylindrical shaft having a tip adapted to seat the replacement pin. This tool also includes a slide hammer and a handle attached to the cylindrical shaft. To insert the replacement pin into an aperture defined in a backplane, the replacement pin is seated into the tip of the cylindrical shaft and an end of the replacement pin is slightly advanced into the backplane aperture. The technician operating the tool must then grasp the handle thereof with one hand while operating the slide hammer with the other hand. In particular, the slide hammer must be grasped by the technician's other hand and manually moved toward the tip the cylindrical shaft until the slide hammer strikes a stop member positioned on the cylindrical shaft. By striking the aforementioned stop member, the momentum of the slide hammer is transferred to the tip of the cylindrical shaft thereby driving the replacement pin into the connector or header and the backplane aperture. The above described actuation of the slide hammer is then repeated until the replacement pin is driven into place.

While the aforementioned tool allows the technician to insert a replacement pin into a backplane, it is relatively large and cumbersome. In particular, the slide hammer is rather large and heavy, and thus makes the tool difficult to manipulate in the above described confined spaces. In addition, the tool requires two hands to operate (i.e. the technician must hold the tool with one hand while operating the slide hammer with his or her other hand) which is inconvenient for the technician replacing the pin. Moreover, the tool is relatively expensive and thus adds to the cost of maintaining backplanes.

Therefore, it is desirable to provide an arrangement and method for repairing an electrical assembly which overcomes one or more of the above discussed problems.

SUMMARY OF THE INVENTION

In one embodiment, the present invention provides an arrangement for repairing an electric assembly having a board and at least one pin insertable thereto. The arrangement includes an actuation assembly which has a housing and a biasing mechanism. The arrangement also includes a pin engaging member configured to engage the pin. The pin engaging member is (i) reciprocally movably secured to the housing and (ii) mechanically coupled to the biasing mechanism such that the biasing mechanism causes movement of the pin engaging member.

In another embodiment, the present invention provides an arrangement for repairing an electric assembly having a board and at least one pin insertable thereto. The arrangement includes an actuation assembly which has (i) a housing having an internal cavity and (ii) a biasing mechanism having a hammer member positioned within the internal cavity. The arrangement also includes a pin engaging member configured to engage the pin. The pin engaging member is (i) reciprocally movably secured to the housing and (ii) mechanically coupled to the biasing mechanism such that the biasing mechanism operates to automatically cause the hammer member to strike the pin engaging member, thereby urging the pin engaging member into an extended position when the pin engaging member is biased toward the housing with a predetermined force.

In yet another embodiment, the present invention provides a method of repairing an electrical assembly. The method involves the use of a pin engaging member that is secured to an actuation assembly having a housing and a biasing mechanism such that the pin engaging member is (i) reciprocally movably secured to the housing and (ii) mechanically coupled to the biasing mechanism such that the biasing mechanism causes movement of the pin engaging member. The method includes the steps of: placing the tip of the pin engaging member in contact with a first end of a pin; positioning the pin engaging member and the pin relative to the electrical assembly such that a second end of the pin is in contact with a board member of the electrical assembly; advancing the pin engaging member and the pin toward the board member such that the pin engaging member is urged into a retracted position; and causing the pin engaging member to move from the retracted position to an extended position while the pin engaging member is in contact with the pin so as to cause the pin to be advanced through an opening defined in the board member.

The above features and advantages, as well as others, will become more readily apparent to those of ordinary skill in the art by reference to the following detailed description and accompanying drawings.

BRIEF DESCRIPTION OF THE DRAWINGS

FIG. 11 is a side elevational view of the clutch member of the actuation assembly of FIG. 1;

FIG. 12 is an end elevational view of the clutch member shown in FIG. 11;

FIG. 13 is a side elevational view of hammer member of the actuation assembly of FIG. 1;

FIG. 14 is an end elevational view of the hammer member shown in FIG. 13;

DETAILED DESCRIPTION

Figure 5:
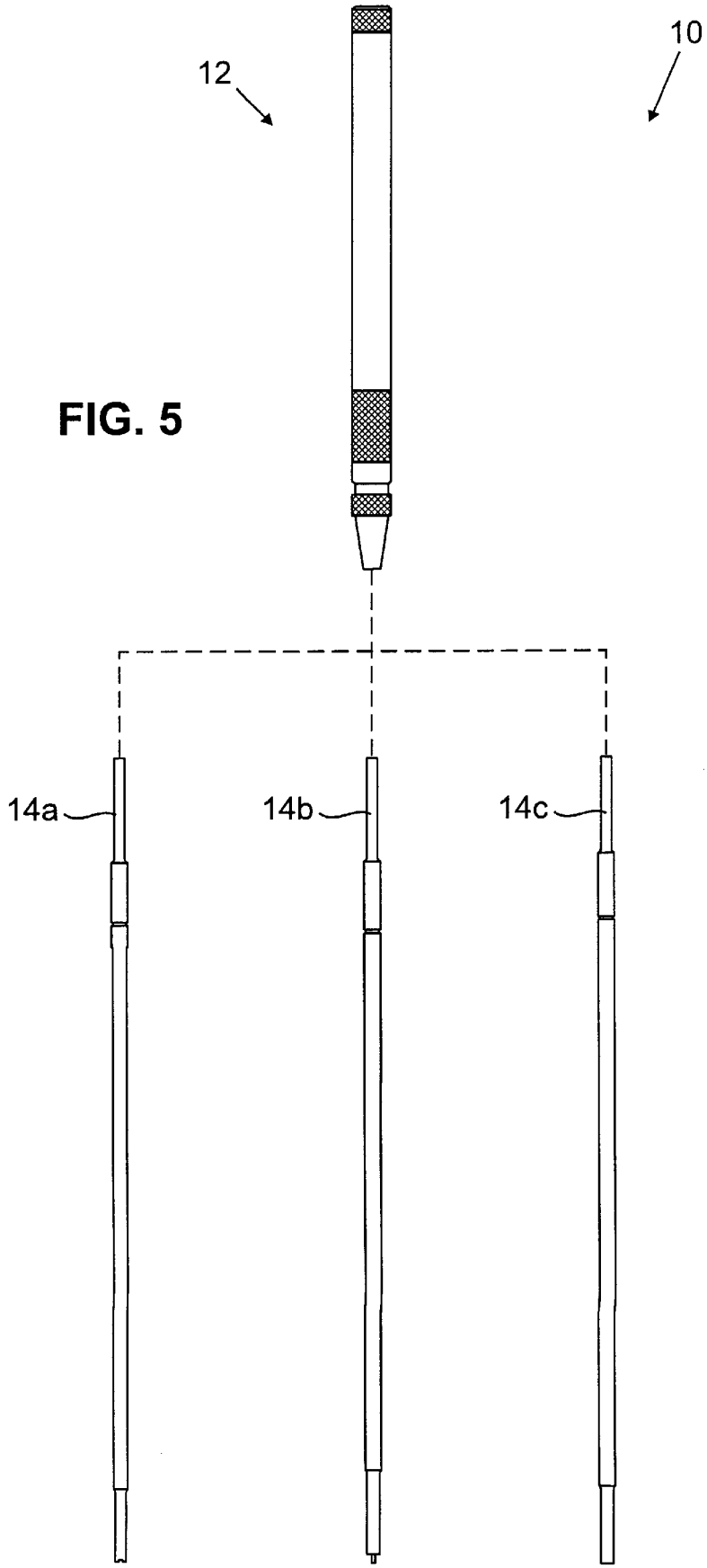
FIG. 5 is a side elevational view of the actuation assembly of FIG. 1 and the pin engaging member of each of FIGS. 2A, 3, and 4.

Referring to FIG. 5, there is shown an arrangement 10 for repairing an electronic assembly having a contact pin which incorporates the features of the present invention therein. Arrangement 10 is particularly usefill for repairing an electronic assembly which includes a backplane assembly 102 (see FIGS. 9 and 10) having a backplane 90, a header 88, and a number of backplane pins 74. The arrangement 10 includes an actuation assembly 12. One actuation assembly 12 which can be used in the present invention is commercially available from General Tools Inc., located in New York, N.Y., as product number 87. The arrangement 10 also includes any one of three pin engaging members 14*a*, 14*b*, or 14*c* which are used in conjunction with the actuation assembly 12. As discussed in greater detail below, only one pin engaging member 14*a*, 14*b*, or 14*c* is used at a time with the actuation assembly 12.

Figure 1:
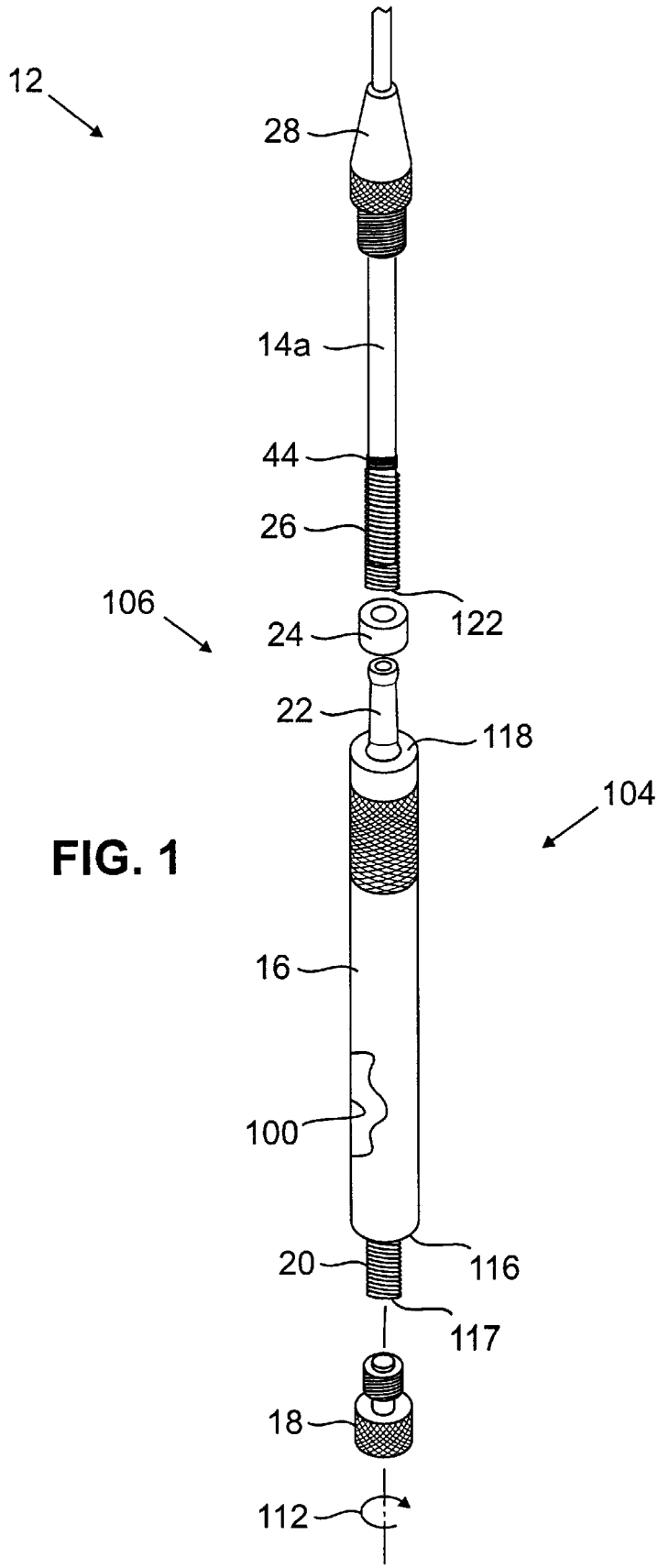
FIG. 1 shows an exploded view of an exemplary embodiment of an actuation assembly in accordance with the present invention.

As shown in FIG. 1, the actuation assembly 12 includes a housing 16 which defines an interior cavity 100. The housing 16 has an elongated shape and may suitably be cylindrical in shape. Actuation assembly 12 also includes a cone member 28, an adjustment member 18, and a biasing mechanism 104. The biasing mechanism 104 in general is a device that exerts a biasing mechanical force to cause movement of the pin engaging members 14*a*, 14*b*, and/or 14*c*. In the exemplary embodiment described herein, the biasing mechanism 104 includes a first spring 20, a second spring 26, and a clutch mechanism 106.

As shown more clearly in FIGS. 11–16, the clutch mechanism 106, includes a clutch member 24 and a hammer member 22. As shown in FIGS. 11 and 12, the clutch member 24 has (i) a concave surface 30 defined thereon and (ii) a lip area 32 which extends upwardly from the concave surface 30. In addition, the clutch member 24 has a clutch aperture 36 defined therethrough. As shown in FIGS. 13 and 14, the hammer member 22 has a head portion 38 and a neck portion 114. In addition, the neck portion 114 of the hammer member 22 has a hammer passageway 40 defined therein.

Referring back to FIG. 1, the first spring 20 is inserted through end 116 of the housing 16 such that the first spring 20 is located within the internal cavity 100. The adjustment member 18 is then rotatably inserted into the end 116 of the housing 16 such that an end 117 of the first spring 20 is seated on the adjustment member 18. The hammer member 22 is then inserted through the end 118 of the housing 16 such that the head portion 38 (see FIG. 13) of the hammer member 22 is seated on the end of the first spring 20 which is the opposite end 117. Clutch member 24 is also inserted through the end 118 of the housing 16 such that an end 46 (see FIGS. 13 and 14) of the hammer member 22 rests on the concave surface 30 of the clutch member 24 (see FIG. 12). In addition, the second spring 26 is inserted through the end 118 of the housing 16 such that an end 122 of the second spring 26 rests on an end 120 (see FIG. 11) of the clutch member 24. It should be appreciated that positioning the clutch mechanism 106 (i.e. the clutch member 24 and the hammer member 22) in the above described manner interposes the clutch mechanism 106 between the first spring 20 and the second spring 26 within the internal cavity 100.

Figure 2A:
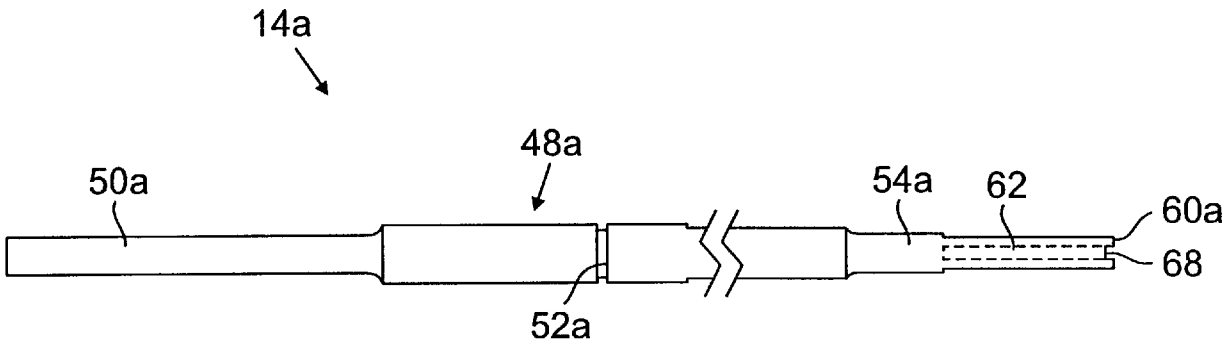
FIG. 2A is a side elevational view of a first embodiment of a pin engaging member of the present invention which is used in conjunction with the actuation assembly of FIG. 1.
Figure 2B:
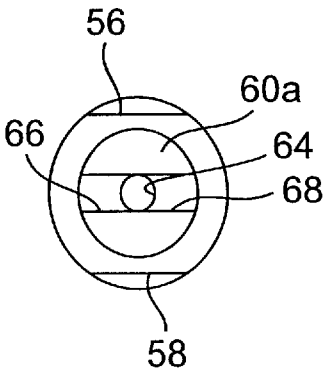
FIG. 2B is an end view of the pin engaging member of FIG. 2A showing the end face thereof.

Although the actuation assembly 12 can be used in conjunction with any of the pin engaging members 14*a*, 14*b*, or 14*c*, the following discussion is initially directed to the pin engaging member 14*a*. As shown in FIG. 2A, the pin engaging member 14*a* includes a shaft 48*a* having a groove 52*a* defined therein. The pin engaging member 14*a* also includes a rod 50*a* extending from one end of the shaft 48*a*. The pin engaging member 14*a* farther includes a tip 54*a* extending from the other end of the shaft 48*a*. Tip 54*a* is configured to engage a backplane pin 74. To this end, tip 54*a* has an end face 60*a* (see FIG. 2B) with an aperture 64 defined therein. Tip 54*a* has a generally circular cross section, but preferably includes a pair of planar portions 56 and 58 defined on the outer periphery thereof. The planar portions 56 and 58 resemble cutaway sections of the outer circular periphery of the cross section of the tip 54*a*. As discussed in greater detail below, the planar portions 56 and 58 allow a technician using arrangement 10 to visually confirm that the tip 54*a* is rotated to the appropriate orientation relative to the backplane pin 74 so that the backplane pin 74 can be properly "loaded" into the tip 54*a*. The aperture 64 leads to a bore 62 (see FIG. 2A) for receiving a first portion 76 of the backplane pin 74 (see FIG. 6). End face 60*a* also has a slot 66 defined therein. The slot 66 terminates in the aperture 64 such that the aperture 64 is interposed between the bore 62 and the slot 66. The slot 66 is adapted to receive a second portion 80 of the backplane pin 74 (see FIG. 6).

Figure 6:
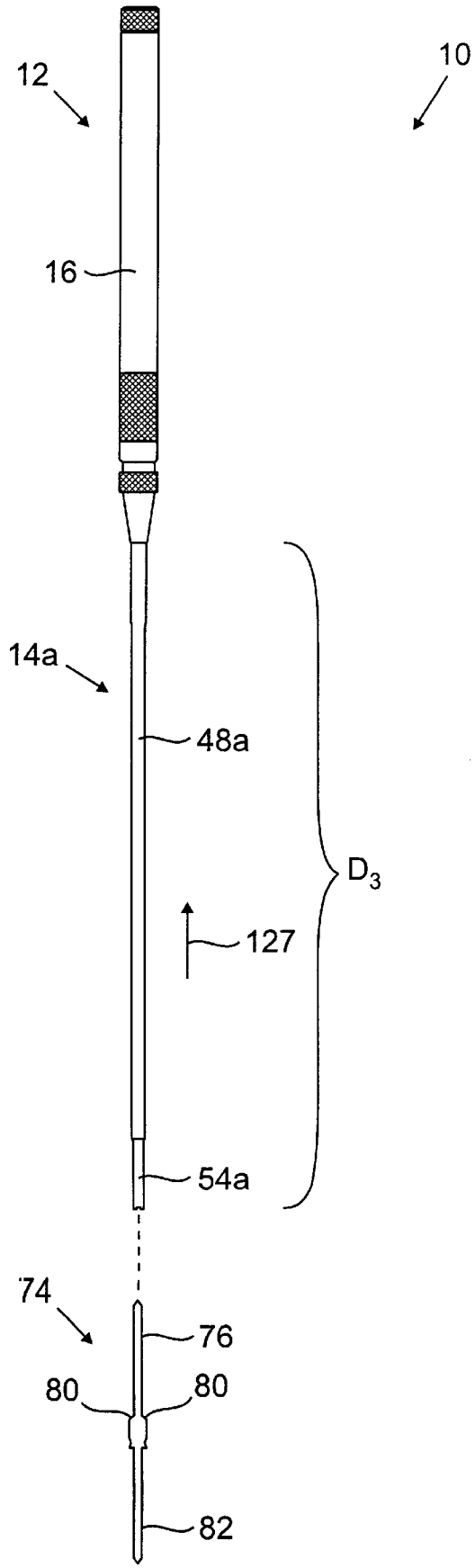
FIG. 6 is a side elevational view of a replacement backplane pin and the actuation assembly of FIG. 1 coupled with the pin engagement member of FIG. 2A.

Referring to FIG. 1, the rod 50*a* of the pin engaging member 14*a* is inserted through the second spring 26 so that an end of the spring 26 rests on a washer 44 disposed in groove 52*a* of the shaft 48*a*. The pin engaging member 14*a* is also positioned relative to the clutch member 24 so that a portion of the rod 50*a* extends into the clutch aperture 36. Shaft 48*a* and the tip 54*a* of the pin engaging member 14*a* are inserted through the cone 28. The cone 28 is then rotatably inserted into the end 118 of the housing 16 so that the shaft 48*a* and the tip 54*a* extend out of the cone 28 as shown in FIG. 6.

It should be understood that mounting the pin engaging member 14*a* within the internal cavity 100 of the housing 16 in the above described manner, as seen in FIG. 1, secures the pin engaging member 14*a* to the housing 16 such that the pin engaging member 14*a* is reciprocally movable with respect to the housing 16. In addition, mounting the pin engaging member 14*a* in the above described manner mechanically couples the pin engaging member 14*a* to the biasing mechanism 104 such that the biasing mechanism 104 causes movement of the pin engaging member 14*a* relative to the housing 16 from (1) a retracted position (see FIG. 7) in which the tip 54*a* of the pin engaging member 14*a* is urged toward the housing 16 so as to be located a distance $D_1$ from the housing 16 to (2) an extended position (see FIG. 8) in which the tip 54*a* of the pin engaging member 14*a* is urged away from the housing 16 so as to be located a distance $D_2$ from the housing 16. As will be discussed in greater detail below, distance $D_1$ is less than distance $D_2$.

Figure 7:
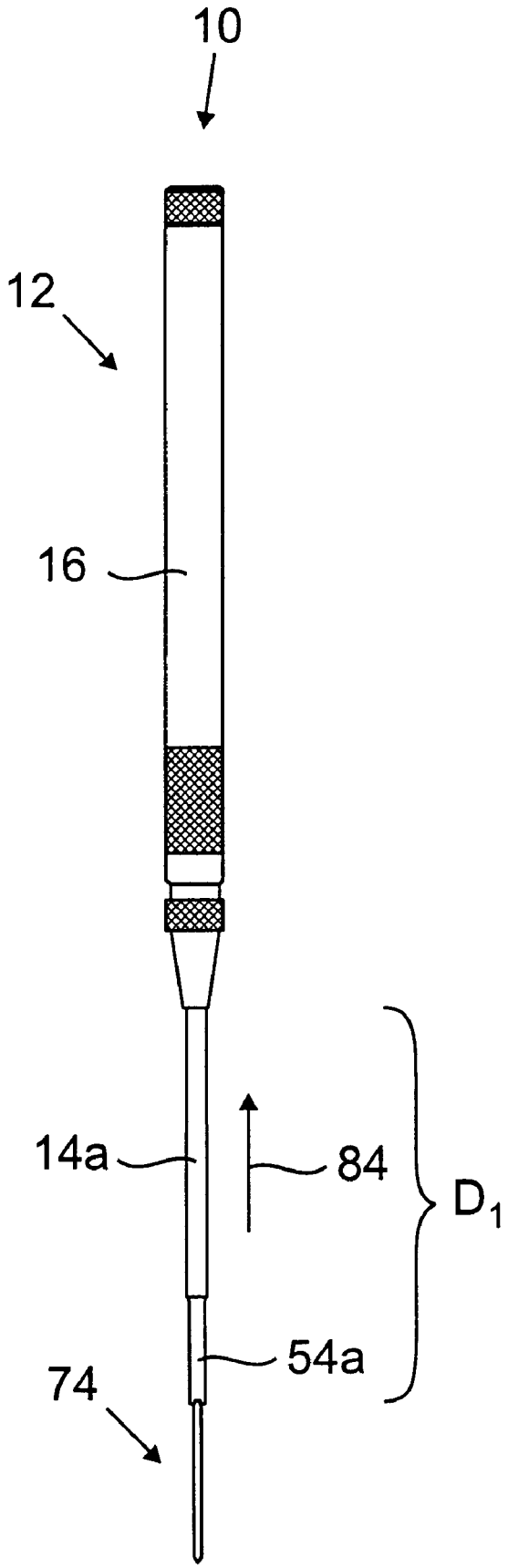
FIG. 7 is a view similar to FIG. 6, but showing the replacement backplane pin seated in the tip of the pin engagement member and the pin engagement member located in the retracted position.
Figure 8:
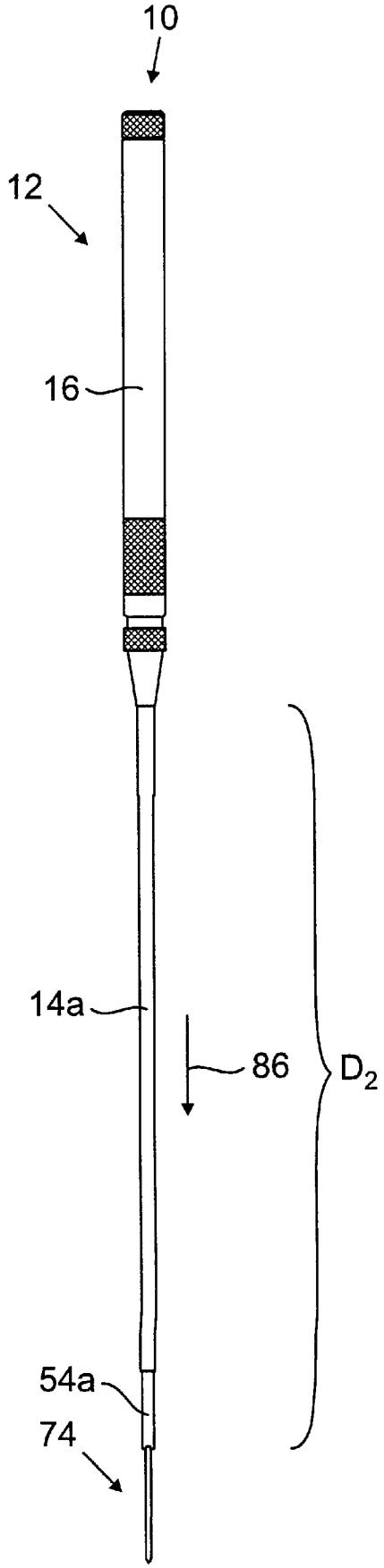
FIG. 8 is a view similar to FIG. 7, but showing the pin engagement member located in the extended position.
Figure 15:
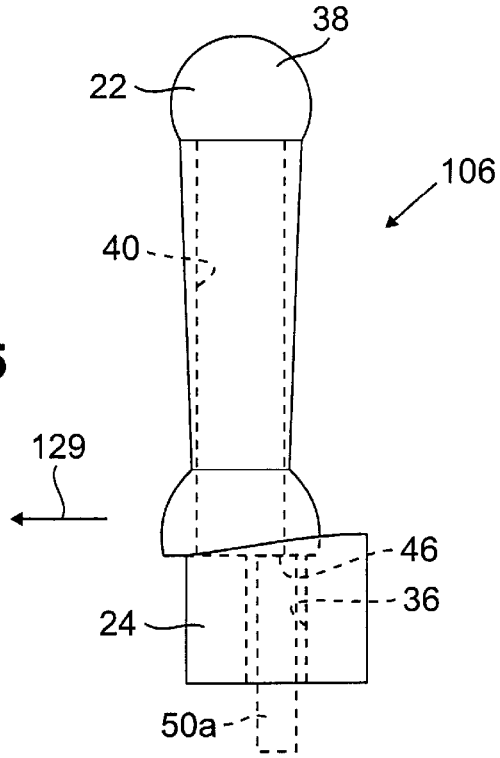
FIG. 15 is a side elevational view of the clutch mechanism of the actuation assembly of FIG. 1, showing the hammer passageway and the clutch passageway in the offset position.
Figure 16:
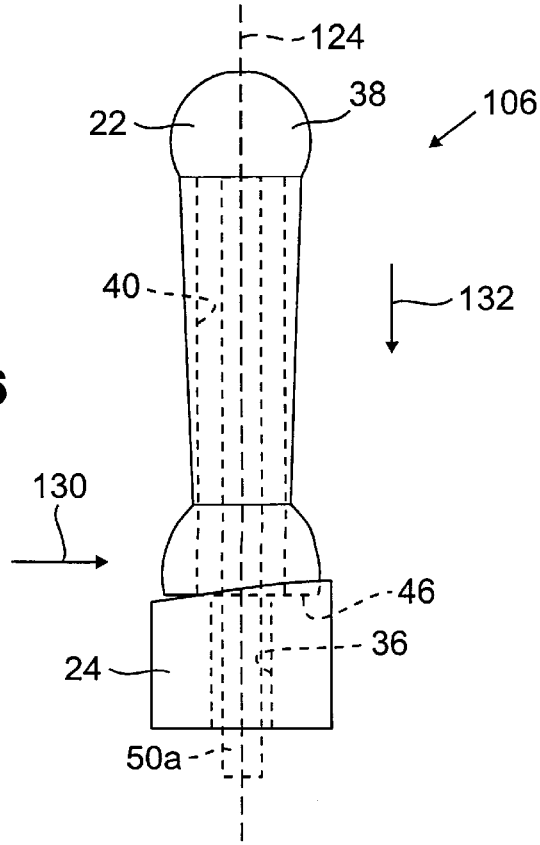
FIG. 16 is a view similar to FIG. 15 but showing the hammer passageway and the clutch passageway in the linearly aligned position.

In particular, as seen in FIGS. 7 and 8, during the operation of the arrangement 10 the biasing mechanism 104, FIG. 1, operates to automatically urge the pin engaging member 14*a* from the retracted position to the extended position when the tip 54*a* thereof is biased toward the housing 16 with a predetermined force. Specifically, the clutch mechanism 106 of the biasing mechanism 104 is positionable between (i) an offset position as shown in FIG. 15 and (ii) a linearly aligned position as shown in FIG. 16. In the offset position, the head portion 38 of the hammer member 22 is held spaced-apart from the pin engaging member 14*a*. By contrast, in the linearly-aligned position, the head portion 38 of the hammer member 22 is spring biased to engage the pin engaging member 14*a*.

The clutch mechanism 106 operates such that when an external biasing force causes retracting the pin engaging member 14*a* to reach a threshold, the clutch mechanism 106 moves to the aligned position, which in turn causes the head portion 38 of the hammer member 22 to engage the pin engaging member 14*a*, thereby causing the pin engaging member 14*a* to move to the extended position. The external biasing force is caused by an operator advancing the housing 16 toward a backplane to insert or remove a pin as discussed below.

In particular, as shown in FIG. 15, when the clutch mechanism 106 is located in the offset position, the hammer member 22 is located relative to the clutch member 24 so that the hammer passageway 40 is offset from the clutch aperture 36. In other words, the hammer passageway 40 and the clutch aperture 36 are positioned relative to each other such that the end surface 46 (see FIG. 14) of the hammer member 22 partially obstructs the clutch aperture 36. However, as shown in FIG. 16, when the clutch mechanism 106 is located in the linearly aligned position, the hammer member 22 is located relative to the clutch member 24 so that the hammer passageway 40 is linearly aligned with the clutch aperture 36. In other words, the hammer passageway 40 and the clutch aperture 36 are positioned relative to each other such that (i) the end surface 46 of the hammer member 22 does not obstruct the clutch aperture 36 and (ii) the hammer passageway 40 and the clutch aperture 36 have substantially the same center line 124.

As previously mentioned, transitioning the clutch mechanism 106 to the aligned position from the offset position causes the pin engaging member 14*a* to transition from the retracted position to the extended position. When the arrangement 10 is at rest, the clutch mechanism 106 reverts to the offset position.

Specifically, as shown in FIG. 6, when no external biasing force is urging the pin engaging member 14*a* toward the housing 16 in the direction indicated by the arrow 127, the pin engaging member 14*a* is located in the relaxed position. When the pin engaging member 14*a* is located in the relaxed position, the tip 54*a* of the pin engaging member 14*a* extends out of the housing 16 at a distance $D_3$. It should be appreciated that the lip area 32 and the concave surface 30, see FIG. 12, of the clutch member 24 directs the end surface 46 (see FIGS. 13 and 14) of the hammer member 22 in the direction indicated by the arrow 129 (see FIG. 15) when the pin engaging member 14*a* is located in the relaxed position. Therefore, it should be understood that when the pin engaging member 14*a* is in the relaxed position, the clutch mechanism 106 is located in the offset position as shown in FIG. 15. When the clutch mechanism 106 is located in the offset position, the rod 50*a* of the pin engaging member 14*a* extends through the clutch aperture 36 and is urged against the end surface 46 of the hammer member 22.

Referring now to FIG. 7, in order to position the pin engaging member 14*a* from the relaxed position to the retracted position, a biasing force is applied to the pin engaging member 14*a* (and therefore the tip 54*a*) in the direction indicated by the arrow 84. The biasing force is typically applied by a human technician advancing the housing 16 toward the pin 74 and contact between the backplane and the pin 74 providing resistance. Applying the biasing force in the above described manner results in the pin engaging member 14*a* being advanced into the housing 16 in the direction of the arrow 84, thereby locating the tip 54*a* of the pin engaging member 14*a* a distance $D_1$ from the housing 16. Note that distance $D_1$ is less than distance $D_3$. Advancing the pin engaging member 14*a* into the housing 16 in the above described manner results in the rod 50*a* of the pin engaging member 14*a* being urged against the end surface 46 of the hammer member 22 with a greater force as compared to when the pin engaging member 14*a* is located in the relaxed position. Moreover, as the pin engaging member 14*a* is advanced into the housing 16 the first spring 20 and the second spring 26 are compressed until the pin engaging member 14*a* is biased toward the housing 16 with a predetermined force.

As shown in FIG. 16, once the pin engaging member 14*a* is biased toward the housing 16 with the aforementioned predetermined force, the force applied to the end surface 46 by the rod 50*a* results in the hammer member 22 being forced to moved relative to the clutch member 24 in the direction indicated by the arrow 130. In other words, the end of the rod 50*a* is able to slip past the end surface 46 of the hammer member 22 when the aforementioned predetermined force is applied. Moving the hammer member 22 in the above described manner results in the clutch mechanism 106 being positioned in the aligned position. Once the clutch mechanism 106 is located in the aligned position, the decompression force of the first spring 20 urges the hammer member 22 in the direction indicated by the arrow 132 so that a portion of the rod 50*a* extends into the hammer passageway 40 and contacts the head portion 38. As shown in FIG. 8, the force of the impact caused by the rapidly advancing hammer member 22 in the direction of the arrow 132 (via compressed first spring 20 and second spring 26) so that the head portion 38 impacts the rod 50*a* results in the pin engaging member 14*a* (and therefore the tip 54*a*) being advanced out of the housing 16 toward the extended position. In particular, when the head portion 38 impacts the rod 50*a* in the above described manner the pin engaging member 14*a* is advanced out of the housing 16 in the direction of the arrow 86 (see FIG. 8), thereby locating the tip 54*a* of the pin engaging member 14*a* a distance $D_2$ from the housing 16. Note that distance $D_1$ is also less than distance $D_2$.

Referring now to FIGS. 6–10, when the actuation assembly 12 and the pin engaging member 14*a* are used to repair the backplane assembly 102 (i.e. replace a pin in the backplane assembly 102) the backplane pin 74 is "loaded" into the tip 54*a* of the pin engaging member 14*a*. Specifically, the backplane pin 74 is positioned relative to the tip 54*a* so that (i) the first portion 76 of the backplane pin 74 is inserted into the bore 62 (see FIG. 2A). (ii) the second portions 80 are seated into the slot 66 (see FIG. 2B), and (iii) a third portion 82 of the backplane pin 74 extends outwardly from the end face 60*a* (see FIG. 2B).

Figure 9:
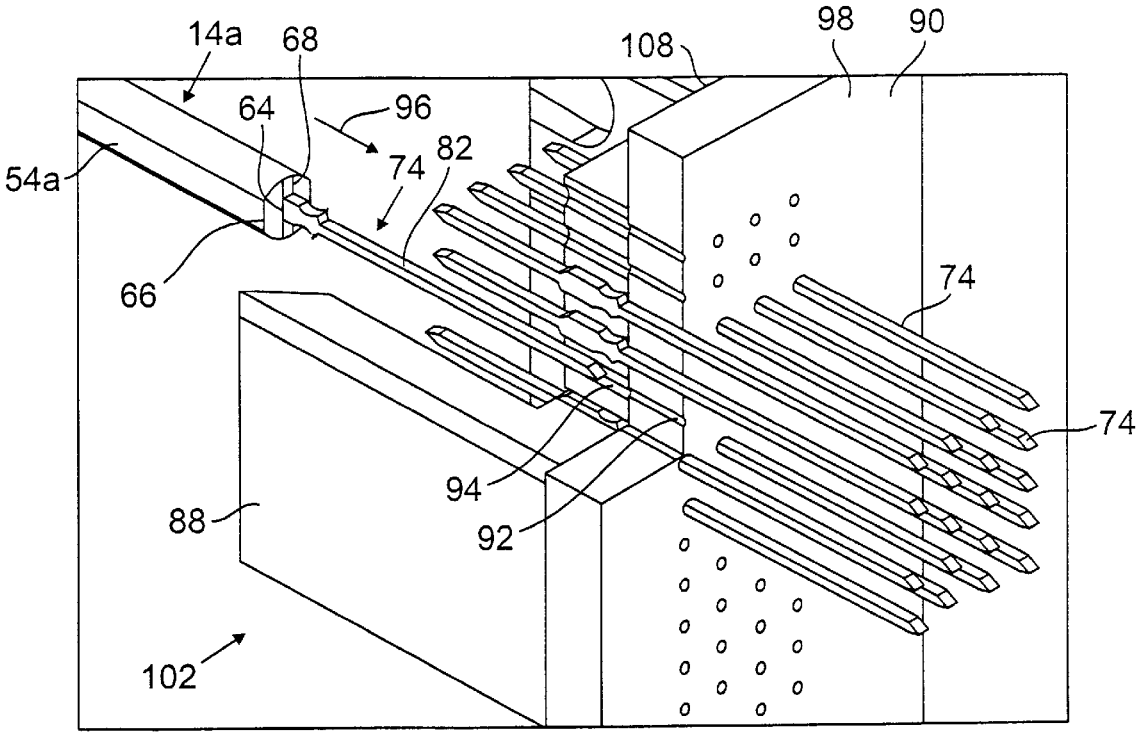
FIG. 9 is a perspective view of the tip of the pin engagement member of FIG. 2A and a backplane assembly just prior to a replacement backplane pin being advanced through an aperture defined in the backplane assembly.

As shown in FIG. 9, once the backplane pin 74 is "loaded" into the tip 54*a* in the above described manner, the tip 54*a* of the pin engaging member 14*a* is positioned relative to the backplane assembly 102 so that the backplane pin 74 is linearly aligned with an aperture 94 defined in the header 88 secured to the backplane 90 and an aperture 92 defined in the backplane 90. Once aligned, the actuation assembly 12 (see FIG. 6), the pin engaging member 14*a*, and the backplane pin 74 are moved toward the backplane assembly 102 in the direction of the arrow 96 (see FIG. 10) until the third portion 82 of the backplane pin 74 contacts the edges of the aperture 94 defined in the header 88. Once the aforementioned contact is made, the actuation assembly 12 is advanced further in the direction indicated by the arrow 96.

It should be understood that at this point the resistance between the edges of the aperture 92 and the third portion 82 of the backplane pin 74 prevent the backplane pin 74 from being advanced through the apertures 94 and 92. Therefore, as the actuation assembly 12 is further advanced toward the backplane 90 in the direction indicated by the arrow 96, the pin engaging member 14*a* is advanced into the housing 16 (see FIG. 7) such that the pin engaging member 14*a* is no longer positioned in the relaxed position (see FIG. 6) but rather begins to retract, thereby eventually locating the tip 54*a* a distance $D_1$ from the housing 16 (see FIG. 7).

After the pin engaging member 14*a* is located in the retracted position, the actuation assembly 12 is further advanced toward the backplane 90 in the direction indicated by the arrow 96 until a predetermined force is achieved so that the clutch mechanism 106 of the biasing mechanism 104 is forced into the linearly aligned position (see FIG. 16). As previously discussed, placing the clutch mechanism 106 in the linearly aligned position when the pin engaging member 14*a* is in the retracted position results in the hammer member 22 striking the pin engaging member 14*a*. The force of the hammer strike urges the pin engaging member 14*a* into the extended position (see FIG. 8) thereby locating the tip 54*a* a distance $D_2$ from the housing 16. Since distance $D_2$ is greater than distance $D_1$ the movement of the tip 54*a* from the retracted position to the extended position drives the backplane pin 74 through the apertures 94 and 92 as shown in FIG. 9.

However, if the third portion 82 of the backplane pin 74 is not completely driven through the apertures 94 and 92 through movement of the pin engaging member 14*a* from the retracted position to the extended position a single time, the above process can be repeated as many times as necessary. In particular, the housing 16 can be moved away from the backplane 90 while the backplane pin 74 remains "loaded" in the tip 54*a* and partially inserted through the apertures 94 and 92 so as to return the pin engaging member 14*a* to the relaxed position. Once the pin engaging member 14*a* is positioned in the relaxed position the above described process can be repeated.

If the pin engaging member 14*a* needs to be urged into the extended position with a greater force in order to drive the backplane pin 74 through the apertures 94 and 92, the adjustment member 18 can be rotated from a first position to a second position to increase this force. In particular, since the adjustment member 18 is mechanically coupled to the first spring 20, the adjustment member 18 can be rotated relative to the housing 16 in the direction indicated by the arrow 112 (see FIG. 1) so as to compress and thus pre-load the first spring 20. Pre-loading the first spring 20 increases the force with which the pin engaging member 14*a* is urged into the extended position by the first spring 20.

Likewise, if less force is needed, the adjustment member 18 can be rotated relative to the housing 16 in the opposite direction indicated by the arrow 112 (see FIG. 1) so as to unload the first spring 20, thereby decreasing the force with which the pin engaging member 14*a* is urged into the extended position by the first spring 20.

Driving the backplane pin 74 through the apertures 94 and 92 in the above described manner results in the first portion 76 (see FIG. 6) of the backplane pin 74 extending from the exterior surface 108 of the backplane 90, and the third portion 82 (see FIG. 6) of the backplane pin 74 extending from the exterior surface 98 of the backplane 90. Having the aforementioned portions extending from the backplane 90 makes the backplane pin 74 accessible for electrical connections on the front or back of the backplane 90.

In addition to installing backplane pins, the exemplary embodiment of the arrangement 10 of the present invention disclosed herein may be configured to assist in removing broken backplane pins. Referring again to FIG. 10, backplane pins 134 and 136 illustrated therein are broken and require removal. Normally, broken pins may be removed utilizing special tweezers, not shown, which grasp the portion of the broken pin extending up from the surface 108.

Figure 10:
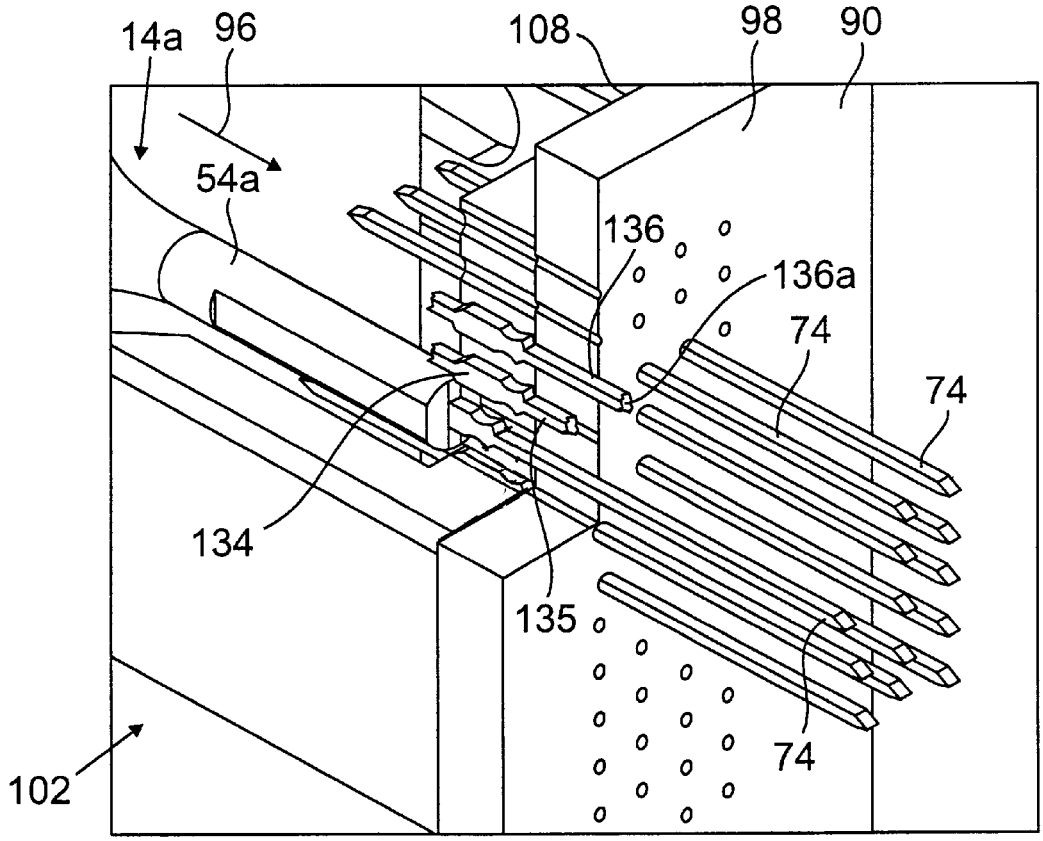
FIG. 10 is a view similar to FIG. 9, but showing the replacement backplane pin after it has been advanced through the aperture defined in the backplane assembly by the tip of the pin engaging member.

However, as illustrated by the backplane pins 134 and 136 of FIG. 10, pins are sometimes broken too close to the surface 108 (or a layer of seating material adjacent thereto) to allow the tweezers enough surface to grip the pin properly. In such a case, it is necessary to advance the pins 134 and 136 further out from the surface 108 to facilitate removal by the tweezers.

As discussed below in detail, the use of the pin engaging members 14*b* and 14*c* help advance broken pins at least partially out of the backplane 90 in the direction opposite of the arrow 96. The pin engaging member 14*b* assists in removing backplane pins that are broken off at or below the surface 98, such as the backplane pin 134. The pin engaging member 14*c* assists in removing backplane pins that are broken off above the surface 98, such as the backplane pin 136.

Figure 3:
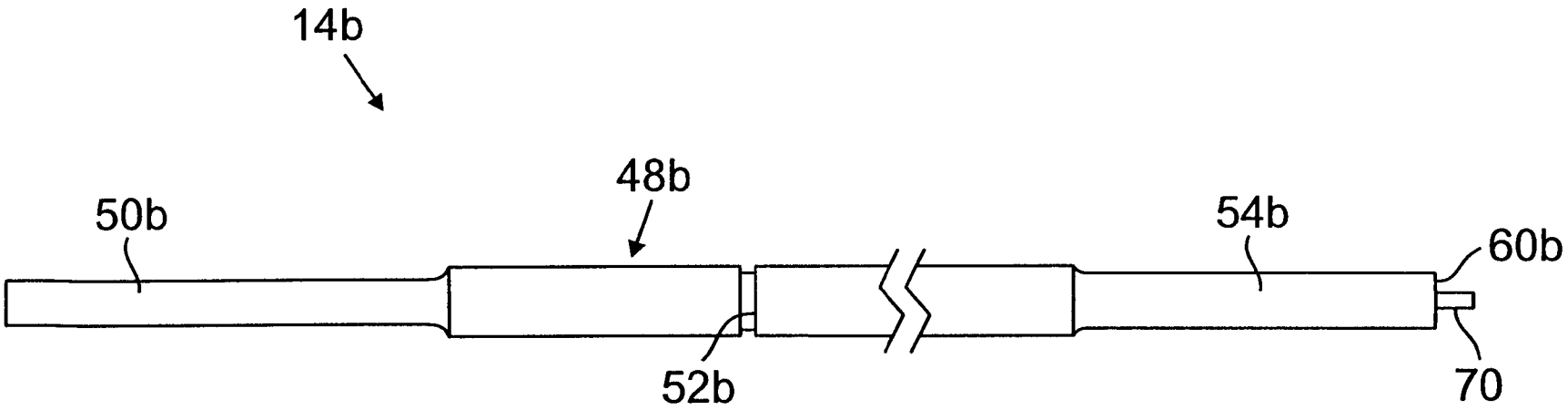
FIG. 3 is a side elevational view of a second embodiment of a pin engaging member of the present invention which is used in conjunction with the actuation assembly of FIG. 1.

Referring now to FIG. 3, the pin engaging member 14*b* has a similar structure to the pin engaging member 14*a*. In particular, the pin engaging member 14*b* includes a shaft 48*b* having a groove 52*b* defined therein. Pin engaging member 14*b* also includes a rod 50*b* extending from one end of the shaft 48*b*. Pin engaging member 14*b* further includes a tip 54*b* extending from the other end of the shaft 48*b*. However, in contrast to the tip 54*a*, the tip 54*b* has an end face 60*b* with an extension member 70 protruding therefrom. Pin engaging member 14*b* is secured to the actuation assembly 12 in the same manner as described above in reference to the pin engaging member 14*a*. Moreover, the pin engaging member 14*b* is utilized in a manner which is substantially similar to that described above in reference to the pin engaging member 14*a*. However, the pin engaging member 14*b* is used to remove a backplane pin 134 (see FIG. 10) from the backplane 90 which is short or has broken off so that an end portion 135 of the backplane pin 134 is positioned between the exterior surfaces 98 and 108 of the backplane 90 (see FIG. 10).

In particular, during use of the pin engaging member 14*b*, the actuation assembly 12 and the pin engaging member 14*b* are positioned relative to the backplane assembly 102 so that the extension member 70 is linearly aligned with the portion 135 of the backplane pin 134 that is positioned between the exterior surfaces 98 and 108 of the backplane 90. Once aligned, the actuation assembly 12 and the pin engaging member 14*b* are moved toward the backplane assembly 102 in the opposite direction of the arrow 96 (see FIG. 10; note that the pin engaging member 14*b* is not shown in FIG. 10) until the extension member 70 contacts the portion 135 of the backplane pin 134.

Once the aforementioned contact is made, the actuation assembly 12 is advanced further in the opposite direction indicated by the arrow 96. As the actuation assembly 12 is further advanced toward the backplane 90 in the opposite direction indicated by the arrow 96, the pin engaging member 14*b* is advanced into the housing 16 such that the pin engaging member 14*b* is no longer positioned in the relaxed position but rather assumes the retracted position thereby locating the tip 54*b* a distance $D_1$ from the housing 16.

After the pin engaging member 14*b* is located in the retracted position the actuation assembly 12 is still further advanced toward the backplane 90 in the opposite direction indicated by the arrow 96 until a predetermined threshold force is achieved. The predetermined threshold force causes the clutch mechanism 106 of the biasing mechanism 104 to translate into the linearly aligned position (see FIG. 16). When the clutch mechanism 106 is in the linearly aligned position, the first spring 20 urges the head member 38 of the hammer member 22 to strike the pin engaging member 14*b*. The force of the hammer strike causes the pin engaging member 14*b* to move into the extended position thereby locating the tip 54*b* (and thus the extension member 70) a distance $D_2$ from the housing 16. Since distance $D_2$ is greater than distance $D_1$, the movement of the tip 54*b* from the retracted position to the extended position drives the backplane pin 134 at least partially out of the backplane 90. Once a portion of the pin 134 has been successfully driven out of the backplane 90, tweezers or the like may be used to extract the pin 134 completely out. The actuation assembly 12 and the pin engaging member 54*a* can then be utilized to insert a new backplane pin into the backplane 90 at the same position in which the backplane pin 134 was located.

Figure 4:
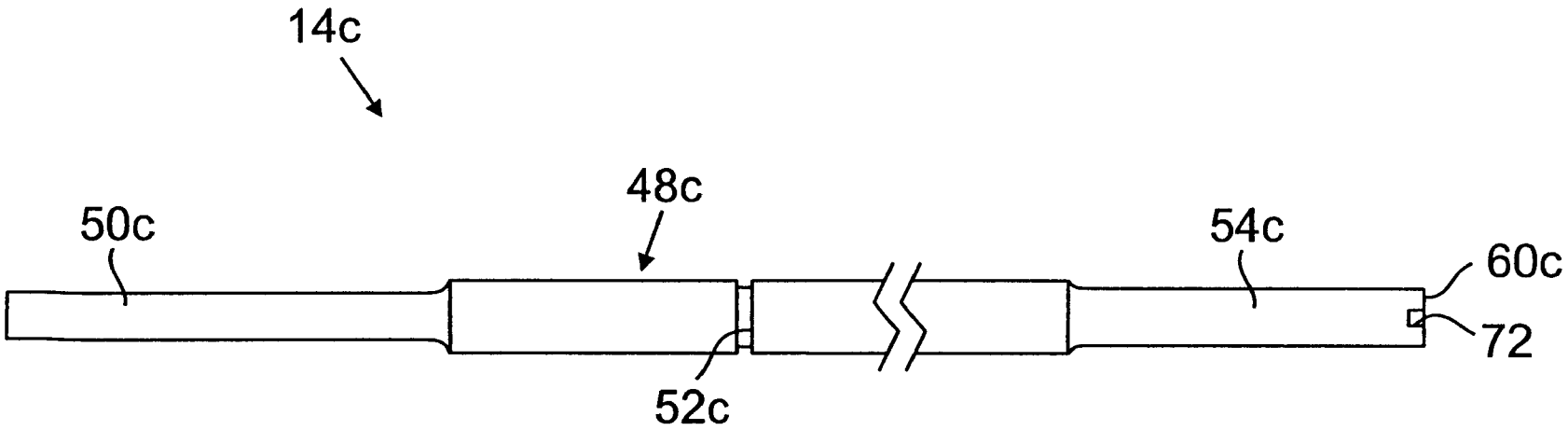
FIG. 4 is a side elevational view of a third embodiment of a pin engaging member of the present invention which is used in conjunction with the actuation assembly of FIG. 1.

Referring now to FIG. 4, the pin engaging member 14*c* also has a similar structure to pin engaging member 14*a*. In particular, the pin engaging member 14*c* includes a shaft 48*c* having a groove 52*c* defined therein. The pin engaging member 14*c* also includes a rod 50*c* extending from one end of the shaft 48*c*. The pin engaging member 14*c* further includes a tip 54*c* extending from the other end of the shaft 48*c*. However, in contrast to tip 54*a*, tip 54*c* has an end face 60*c* with a cavity 72 defined therein. Cavity 72 has a length which is shorter than the bore 62 (i.e. not as deep as bore 62) of the pin engaging member 14*a* since the pin engaging member 14*c* is used to drive the backplane pins at least partially out of the backplane 90, and thus the backplane pin does not have to be "loaded" or aligned by the engaging member 14*c* as described above for the pin engaging member 14*a*.

The pin engaging member 54*c* is secured to the actuation assembly 12 in the same manner as described above in reference to the pin engaging member 54*a*. Moreover, pin engaging member 54*c* is utilized in a manner which is substantially similar to that described above in reference to the pin engaging member 54*a*. However, the pin engaging member 14*c* is used to remove a backplane pin 136 (see FIG. 10) from the backplane 90 which is bent or has broken off so that a portion of the backplane pin 136 which extends above the exterior surface 108 of the backplane 90 (see FIG. 10).

In particular, during use of the pin engaging member 14*c*, the actuation assembly 12 and the pin engaging member 14*c* are positioned relative to the backplane assembly 102 so that the cavity 72 is linearly aligned with the portion 136*a* of the backplane pin 136 that extends outwardly from the exterior surface 98 of the backplane 90. Once aligned, the actuation assembly 12 and the pin engaging member 14*c* are moved toward the backplane assembly 102 in the direction opposite to the direction indicated by the arrow 96 (see FIG. 10; note that the pin engaging member 14*c* is not shown in FIG. 10) until the portion of the backplane pin 136*a* that extends outwardly from the exterior surface 98 of the backplane 90 is located within the cavity 72.

Once the portion of the backplane pin 136*a* is located within the cavity 72, the actuation assembly 12 is further advanced toward the exterior surface 98. As the actuation assembly 12 is further advanced toward the exterior surface 98, the pin engaging member 14*c* is advanced into the housing 16 such that the pin engaging member 14*c* is no longer positioned in the relaxed position but rather assumes the retracted position thereby locating the tip 54*c* a distance $D_1$ from the housing 16. After the pin engaging member 14*c* is located in the retracted position, the actuation assembly 12 is still further advanced toward the exterior surface 98 until a predetermined force is achieved so that the clutch mechanism 106 of the biasing mechanism 104 is located in the linearly aligned position (see FIG. 16). Placing the clutch mechanism 106 in the linearly aligned position results in the pin engaging member 14*c* moving into the extended position thereby locating the tip 54*c* a distance $D_2$ from the housing 16. Since distance $D_2$ is greater than distance $D_1$ the movement of the tip 54*c* from the retracted position to the extended position drives the backplane pin 136 at least partially out of the backplane 90 in the direction opposite to that indicated by the arrow 96. Once the backplane pin 136 is driven at least partially out the backplane 90, tweezers may be then used to extract the backplane pin 134 completely out.

Actuation assembly 12 and the pin engaging member 54*a* can then be utilized to insert a new backplane pin into the backplane 90 at the same position in which the backplane pin 136 was located.

It should be appreciated that the actuation assembly 12 of the present invention can be operated by one hand as opposed to the two hands required to operate an assembly that includes a slide hammer. Therefore, the present invention provides an arrangement 10 for repairing an electrical assembly having a plurality pins which a technician can conveniently operate. It should also be appreciated that since the actuation assembly 12 is relatively small, the present invention provides an arrangement 10 for repairing an electrical assembly having a plurality pins which is easily manipulated in a confined space. Furthermore, the present invention provides an arrangement 10 and method for repairing an electrical assembly having a plurality pins which is relatively inexpensive.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

I claim:

1. An arrangement for repairing an electric assembly having a board and at least one pin insertable to the electric assembly, comprising:

an actuation assembly which includes a housing and a biasing mechanism, an internal cavity being defined by said housing, said biasing mechanism including a hammer member positioned within said internal cavity, said biasing mechanism causing movement of a pin engaging member from a retracted position to an extended position, said biasing mechanism operative to automatically cause said hammer member to strike said pin engaging member, thereby urging said pin engaging member into said extended position when said pin engaging member is biased toward said housing with a predetermined force; and the pin engaging member configured to engage said pin, said pin engaging member being (i) reciprocally movably secured to said housing and (ii) mechanically coupled to said biasing mechanism such that said biasing mechanism causes the movement of said pin engaging member, wherein said biasing mechanism includes a clutch member having a clutch aperture defined therethrough, said hammer member includes a hammer passageway defined therein, said clutch aperture is normally disposed in an offset position with respect to said hammer passageway, and said hammer passageway and said clutch aperture become linearly aligned when an end of said pin engaging member tip is biased toward said housing with a predefined force so as to cause said clutch member to permit said hammer member to move toward and strike said pin engaging member, thereby urging said pin engaging member into said extended position.

2. The arrangement of claim 1, wherein:

said pin engaging member includes a tip having an end face defined thereon, and said end face has a slot defined therein that terminates in an aperture, and wherein the aperture leads to a bore for receiving a first portion of said pin and, said slot is adapted to receive a second portion of said pin.

3. The arrangement of claim 1, wherein:

said pin engaging member includes a tip having an end face defined thereon, and said end face has an extension member extending therefrom for contacting a portion of said pin which is located between first and second exterior surfaces of said board.

4. The arrangement of claim 1, wherein:

pin engaging member includes a tip having an end face defined thereon, and said end face has a cavity defined therein for receiving a portion of said pin which extends outwardly from an exterior surface of said board.

5. The arrangement of claim 1, wherein:

said biasing mechanism includes a first spring for urging said pin engaging member into said extended position.

6. The arrangement of claim 5, further comprising:

an adjustment member (i) mechanically coupled to said first spring, wherein (i) when said adjustment member is located in a first position said first spring urges said pin engaging member into said extended position with a first force and (ii) when said adjustment member is located in a second position said first spring urges said pin engaging member into said extended position with a second force.

7. The arrangement of claim 1, wherein:

said pin engaging member has an end face defined thereon, and said end face has an extension member extending therefrom for contacting a portion of said pin which is located between first and second exterior surfaces of said board.

8. An arrangement for repairing an electric assembly having a board and at least one pin insertable to the electric assembly, comprising:

an actuation assembly which includes (i) a housing having an internal cavity and (ii) a biasing mechanism having a hammer member positioned within said internal cavity; and a pin engaging member configured to engage said pin, said pin engaging member being (i) reciprocally movably secured to said housing and (ii) mechanically coupled to said biasing mechanism such that said biasing mechanism operates to automatically cause said hammer member to strike said pin engaging member, thereby urging said pin engaging member into an extended position when said pin engaging member is biased toward said housing with a predetermined force, wherein said biasing mechanism includes a clutch member having a clutch aperture defined therethrough, said hammer member includes a hammer passageway defined therein, said clutch aperture is normally disposed in an offset position with respect to said hammer passageway, and;

said hammer passageway and said clutch aperture become linearly aligned when an end of said pin engaging member tip is biased toward said housing with a predefined force so as to cause said clutch member to permit said hammer member to move toward and strike said pin engaging member, thereby urging said pin engaging member into said extended position.

9. The arrangement of claim 8, wherein:

said pin engaging member has an end face defined thereon, and said end face has a slot defined therein that terminates in an aperture and wherein the aperture leads to a bore for receiving a first portion of said pin and, said slot is adapted to receive a second portion of said pin.

10. The arrangement of claim 8, wherein:

said pin engaging member has an end face defined thereon, and said end face has a cavity defined therein for receiving a portion of said pin which extends above an exterior surface of said board.

11. The arrangement of claim 8, wherein:

said biasing mechanism includes a first spring for urging said pin engaging member into said extended position.

12. The arrangement of claim 11, further comprising:

an adjustment member (i) mechanically coupled to said first spring, wherein (i) when said adjustment member is located in a first position said first spring urges said pin engaging member into said extended position with a first force and (ii) when said adjustment member is located in a second position said first spring urges said pin engaging member into said extended position with a second force.

* * * * *